US009898981B2

(12) United States Patent
Lee

(10) Patent No.: US 9,898,981 B2
(45) Date of Patent: Feb. 20, 2018

(54) LIQUID CRYSTAL DRIVING APPARATUS AND LIQUID CRYSTAL DISPLAY COMPRISING THE SAME

(71) Applicant: Hydis Technologies Co., Ltd., Icheon-si (KR)

(72) Inventor: Ji-Hoon Lee, Seoul (KR)

(73) Assignee: Hydis Technologies Co., Ltd., Icheon-si (KR)

( * ) Notice: Subject to any disclaimer, the term of this patent is extended or adjusted under 35 U.S.C. 154(b) by 116 days.

(21) Appl. No.: 14/881,096

(22) Filed: Oct. 12, 2015

(65) Prior Publication Data

US 2016/0104443 A1 Apr. 14, 2016

(30) Foreign Application Priority Data

Oct. 10, 2014 (KR) ..... 10-2014-0136915

(51) Int. Cl.
*G09G 3/36* (2006.01)

(52) U.S. Cl.
CPC ..... *G09G 3/3648* (2013.01); *G09G 3/3614* (2013.01); *G09G 3/3677* (2013.01); *G09G 2300/0426* (2013.01); *G09G 2310/0205* (2013.01); *G09G 2310/0251* (2013.01); *G09G 2310/067* (2013.01); *G09G 2320/0233* (2013.01)

(58) Field of Classification Search
None
See application file for complete search history.

(56) References Cited

U.S. PATENT DOCUMENTS

2006/0284815 A1* 12/2006 Kwon ..... G09G 3/3614 345/98
2012/0293536 A1* 11/2012 Yonemaru ..... G09G 3/3648 345/589
2014/0009458 A1* 1/2014 Nam ..... G09G 3/3696 345/212

FOREIGN PATENT DOCUMENTS

JP 2002-108288 A 4/2002
KR 10-2001-0015385 A 2/2001
KR 10-2013-0027920 A 3/2013
KR 10-2014-0038820 A 3/2014

OTHER PUBLICATIONS

Korean Office Action dated Jun. 21, 2015 for Korean Patent Application No. 10-2014-0136915, filed on Oct. 10, 2014 (5 pages).

* cited by examiner

*Primary Examiner* — Ifedayo Iluyomade
(74) *Attorney, Agent, or Firm* — Perkins Coie LLP

(57) ABSTRACT

Provided herein is a liquid crystal driving apparatus and a liquid crystal display comprising the same, the liquid crystal driving apparatus including a gate driver configured to sequentially supply a basic scan pulse to gate lines for 2H period of time using a first clock signal (CPV1); and a data driver configured to supply a data voltage to liquid crystal cells, wherein the gate driver provides an additional scan pulse before or after the 2H period of time using a second clock signal (CPV2), the additional scan pulse being provided for a period of time overlapping a basic scan pulse being supplied to a neighboring gate line.

20 Claims, 12 Drawing Sheets

LIQUID CRYSTAL DRIVING APPARATUS AND LIQUID CRYSTAL DISPLAY COMPRISING THE SAME

CROSS-REFERENCE TO RELATED APPLICATION

This application claims the benefit of priority under 35 U.S.C. § 119(a) of Korean Patent Application No. 10-2014-0136915, filed on Oct. 10, 2014, in the Korean Intellectual Property Office, the entire disclosure of which is incorporated herein by reference for all purposes.

TECHNICAL FIELD

The following description relates generally to a liquid crystal driving apparatus and a liquid crystal display comprising the same.

BACKGROUND

A liquid crystal display consists of a plurality of data lines and gate lines that intersect each other, thereby limiting units of liquid crystal cells, wherein each liquid crystal cell is provided with a switching element arranged where a data line and gate line intersect each other.

The liquid crystal display forms an electric field between a common electrode and a pixel electrode, and controls a rotation angle of the liquid crystal, thereby adjusting an amount of light transmission so as to display a desired image on a screen.

Liquid crystal displays are usually driven in various inversion methods such as frame inversion, column inversion, line inversion, dot inversion and the like in order to reduce deterioration of the liquid crystal.

SUMMARY

This summary is provided to introduce some concepts of the disclosed technology in a simplified form, which will be further discussed in the Detailed Description. This Summary is not intended to identify key features or essential features of the claimed subject matter, nor is it intended to be used as an aid in determining the scope of the claimed subject matter.

Various implementations of the disclosed technology provide a liquid crystal driving apparatus and the liquid crystal display comprising the same, which drive a liquid crystal display where liquid crystal cells of a plurality of lines share a gate line.

Some implementations of the disclosed technology provide a liquid crystal driving apparatus and the liquid crystal display comprising the same, which are capable of striking a balance of the charging characteristics between a plurality of liquid crystal cells, Some implementations of the disclosed technology provide a liquid crystal driving apparatus and the liquid crystal display comprising the same, which are capable of additionally charging a data voltage of a same polarity regardless of the type of data even in a time-shared area.

Some implementations of the disclosed technology provide a liquid crystal driving apparatus and the liquid crystal display comprising the same, which are capable of securing a sufficient charging time for liquid crystal cells.

In one aspect, a liquid crystal display is provided to include: a liquid crystal displayer disposed in an area including a plurality of gate lines, a plurality of data lines intersecting the gate lines, and a plurality of liquid crystal cells disposed in an area defined by the gate lines and data lines, wherein the liquid crystal cells include first liquid crystal cells disposed in odd number lines and connected to a data line disposed at one side of the first liquid crystal cells, second liquid crystal cells disposed in even number lines and connected to a data line disposed at another side of the second liquid crystal cells, and the first liquid crystal cells disposed in a same line and a plurality of the second liquid crystal cells disposed in a neighboring even number line of the same line are connected to a same gate line; and a liquid crystal driving apparatus configured to provide a gate signal and a data signal to the data line and the gate line; n one aspect, a liquid crystal driving apparatus is provided to comprise: a gate driver configured to supply a basic scan pulse to gate lines for 2H period of time using a first clock signal (CPV1); and a data driver configured to supply a data voltage to liquid crystal cells, wherein the gate driver provides an additional scan pulse before or after the 2H period of time using a second clock signal (CPV2), the additional scan pulse being provided for a period of time overlapping the basic scan pulse being supplied to a neighboring gate line.

In some implementations, the liquid crystal driving apparatus further comprises a timing controller configured to adjust a timing of the second clock signal and provide the adjusted timing to the gate driver. In some implementations, the timing controller adjusts a timing of the second clock signal with reference to a look-up table including information on a timing difference between the first clock signal and the second clock signal. In some implementations, information of the look-up table provides that the additional scan pulse is provided for a longer period of time to a liquid crystal cell disposed in an area with a big load in a liquid crystal displayer. In some implementations, information of the look-up table provides that if a gate line is closer to the data driver, the additional scan pulse is provided after the 2H period of time, and if the gate line is farther from the data driver, the additional scan pulse is provided before the 2H period of time. In some implementations, wherein information of the look-up table provides that when the additional scan pulse is provided after the 2H period of time, the time during which the additional scan pulse is provided becomes greater for the gate line closer to the data driver, and when the additional scan pulse is provided before the 2H period of time, the time during which the additional scan pulse is provided becomes greater for the gate line farther away from the data driver. In some implementations, wherein the additional scan pulse is provided between 0H and 1H. In some implementations, wherein the data driver provides a data signal having different polarities from each other to first liquid crystal cells disposed in odd number lines and second liquid crystal cells disposed in even number lines. In some implementations, wherein the gate driver is configured (1) when the first clock signal (CPV1) and the second clock signal (CPV2) completely overlaps each other, to supply only the basic scan pulse to a gate line for the 2H period of time, (2) when the second clock signal is ahead of the first clock signal by as much as t1 period of time, to provide the additional scan pulse for the t1 period of time before the basic scan pulse, and (3) when the second clock signal proceeds after the first clock signal by as much as t2 period of time, to provide the additional scan pulse for the t2 period of time after the basic scan pulse.

Some implementations of the present disclosure provide a liquid crystal driving apparatus and the liquid crystal display comprising the same, where liquid crystal cells arranged on a plurality of lines share a gate line.

Some implementations of the present disclosure allow to reduce the number of gate lines by enabling liquid crystal cells arranged on a plurality of lines to share one gate line, and applying a time-sharing method in a gate driving signal so as to reduce a fan out.

Some implementations of the present disclosure provide a liquid crystal driving apparatus and the liquid crystal display comprising the same, which are capable of striking a balance of charging characteristics between a plurality of liquid crystal cells, and additionally charging a data voltage of a same polarity regardless of the type of data even in a time-shared area, and securing a sufficient charging time for the liquid crystal cells.

Some implementations of the present disclosure provide a liquid crystal driving apparatus and the liquid crystal display comprising the same, which include a gate driver capable of providing a gate signal for pre-charging using two gate clock signals.

Other features and aspects will be apparent from the following detailed description, the drawings, and the claims.

DETAILED DESCRIPTION

Various implementations are disclosed to provide a liquid crystal driving apparatus capable of preventing charging characteristics of liquid crystal cells from becoming non-uniform, and a liquid crystal display comprising the same.

When a liquid crystal display having a plurality of liquid crystal cells that share a data line is driven in the line inversion method, various problems may occur.

Figure 1:
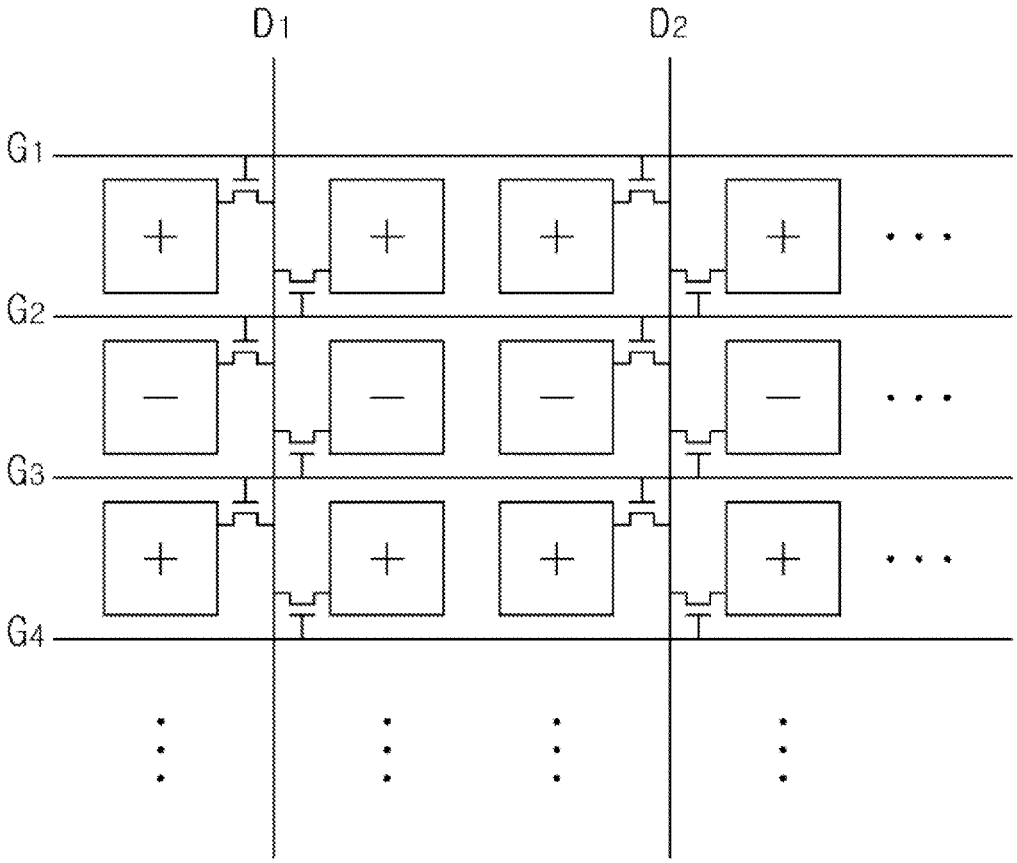
Prior Art FIG. 1
FIG. 1 is an equivalent circuit diagram illustrating a pixel array of a conventional liquid crystal display.

More specifically, there has been suggested a type of liquid crystal display where neighboring liquid crystal cells are configured to share a data line as illustrated in FIG. 1 in order to reduce the number of data lines in the apparatus.

Such a liquid crystal display has liquid crystal cells of which a data input timing of an odd number row and an even number row are time-shared and charged, and a data driver of the line inversion method reverses a polarity of data in horizontal line units to supply the data to the liquid crystal cells.

Figure 2:
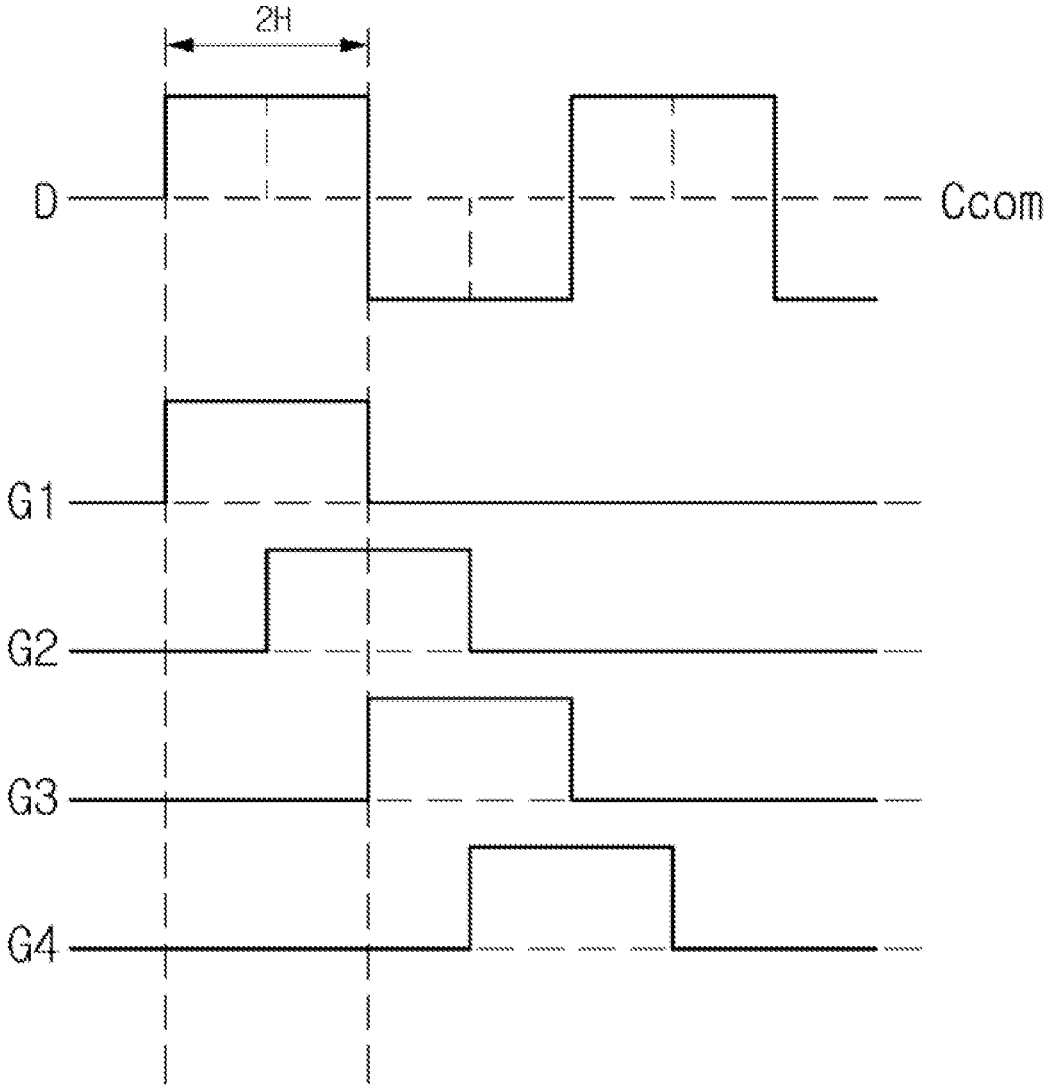
Prior Art FIG. 2
FIG. 2 is a diagram illustrating a data signal and a gate signal for the liquid crystal display illustrated in FIG. 1 to be driven in the line inversion method.

In such a liquid crystal display, a data signal and gate signal are supplied as illustrated in FIG. 2, and liquid crystal cells of an odd number row and liquid crystal cells of an even number row share a same data line. A data voltage being supplied through a same data line is supplied to the liquid crystal cells of an odd number row and the liquid crystal cells of an even number row in a time-shared method. Furthermore, in order to increase a speed of charging the liquid crystal cells, liquid crystal cells of a next horizontal line are pre-charged with a data voltage of a previous horizontal line.

In a case of pre-charging the liquid crystal cells in such a method, the liquid crystal cells of an odd number row will be charged with a data voltage of a different polarity from a pre-charged voltage whereas the liquid crystal cells of an even number row will be charged with a data voltage of the same polarity as the pre-charged voltage. Therefore, even when a voltage of a same tone is supplied, the liquid crystal cells of the even number row will be charged with a greater voltage than the liquid crystal cells of the odd number row, and thus stripes will appear.

Furthermore, the odd number row will be pre-charged with a data voltage of a different polarity, and thus it will be difficult to keep a balance of the charging characteristics between the liquid crystal cells.

Under the recognition above, various implementations according to the present disclosure will be explained with reference to the attached drawings.

Hereinafter, only the components necessary for understanding the liquid crystal driving apparatus according to an embodiment of the present disclosure and a liquid crystal display comprising the same will be explained, and other components will be omitted so as not to obscure the main point of the present disclosure.

As aforementioned, a conventional liquid crystal display illustrated in FIG. 1 is capable of reducing the number of data lines by enabling neighboring liquid crystal cells to share one data line, but when realized in the line inversion method, various problems would occur.

Some implementations of the present disclosure provide a liquid crystal driving apparatus and a liquid crystal display comprising the same, which are capable of enabling liquid crystal cells to share a signal line without causing the problems of the conventional technology.

Figure 3:
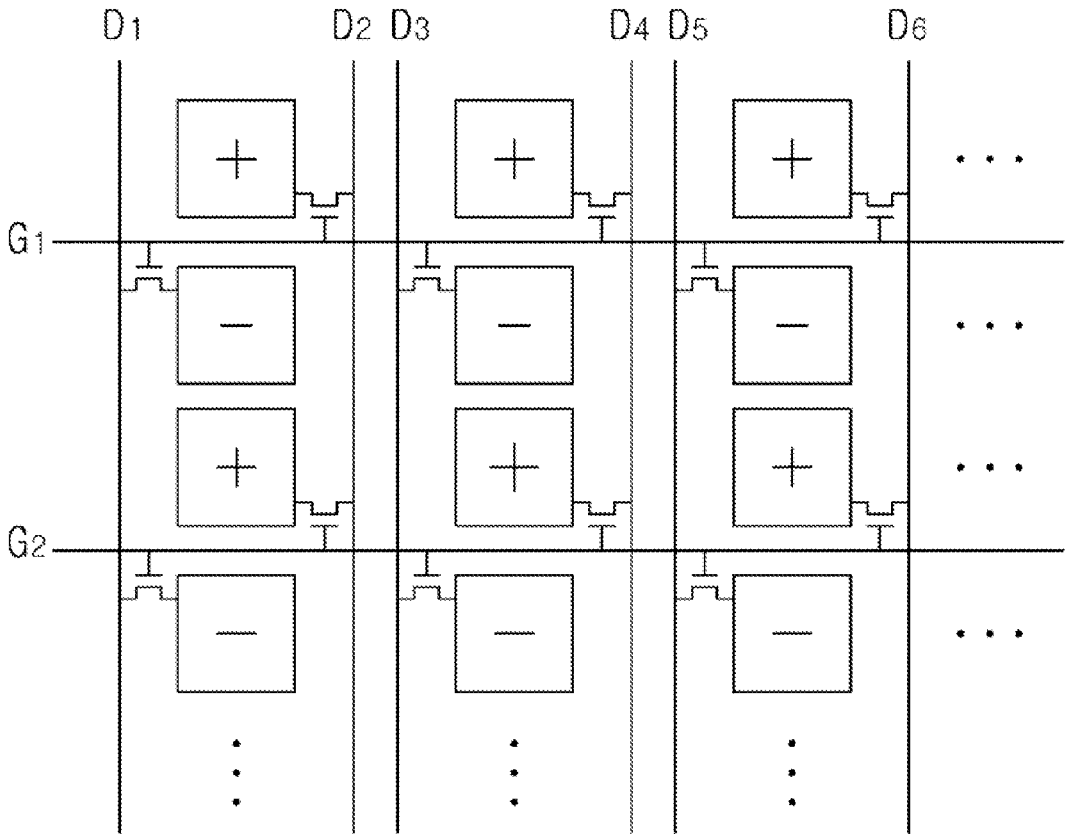
FIG. 3 is an equivalent circuit diagram illustrating a pixel array of a liquid crystal display according to an embodiment of the present disclosure.

An equivalent circuit diagram illustrating a pixel array of such a liquid crystal display according to an embodiment of the present disclosure is illustrated in FIG. 3.

As illustrated in FIG. 3, a liquid crystal displayer of a liquid crystal display according to an embodiment of the present disclosure includes a plurality of gate lines (G), a plurality of data lines (D) that intersect the gate lines, and a plurality of liquid crystal cells inside areas where the gate lines and data lines intersect each other.

Of the plurality of liquid crystal cells, liquid crystal cells disposed in an odd number line are connected to a data line (even number row data line) disposed on its right side, and liquid crystal cells disposed in an even number line are connected to a data line (odd number row data line) disposed on its left side.

Hereinafter, for the sake of easy explanation, the liquid crystal cells disposed in an odd number line will be referred to as first liquid crystal cells, and the liquid crystal cells disposed in an even number line will be referred to as second liquid crystal cells.

Referring to FIG. 3, the first liquid crystal cells are connected to an even number row data line, and the second liquid crystal cells are connected to an odd number row data line, but the first liquid crystal cells may be connected to an odd number row data line, and the second liquid crystal cells may be connected to an even number row data line instead.

Furthermore, a plurality of first liquid crystal cells disposed in a same line and a plurality of second liquid crystal cells disposed in a neighboring even number line are connected to one gate line (G) formed between the first liquid crystal cells and the second liquid crystal cells. That is, the liquid crystal cells of a first line and the liquid crystal cells of a second line are connected to a first gate line (G1), and the liquid crystal cells of a third line and the liquid crystal cells of a fourth line are connected to a second gate line (G2). In such a method, compared to a general liquid crystal display where liquid crystal cells disposed in one line are connected to one gate line, it is possible to reduce the number of gate lines into half.

Figure 4:
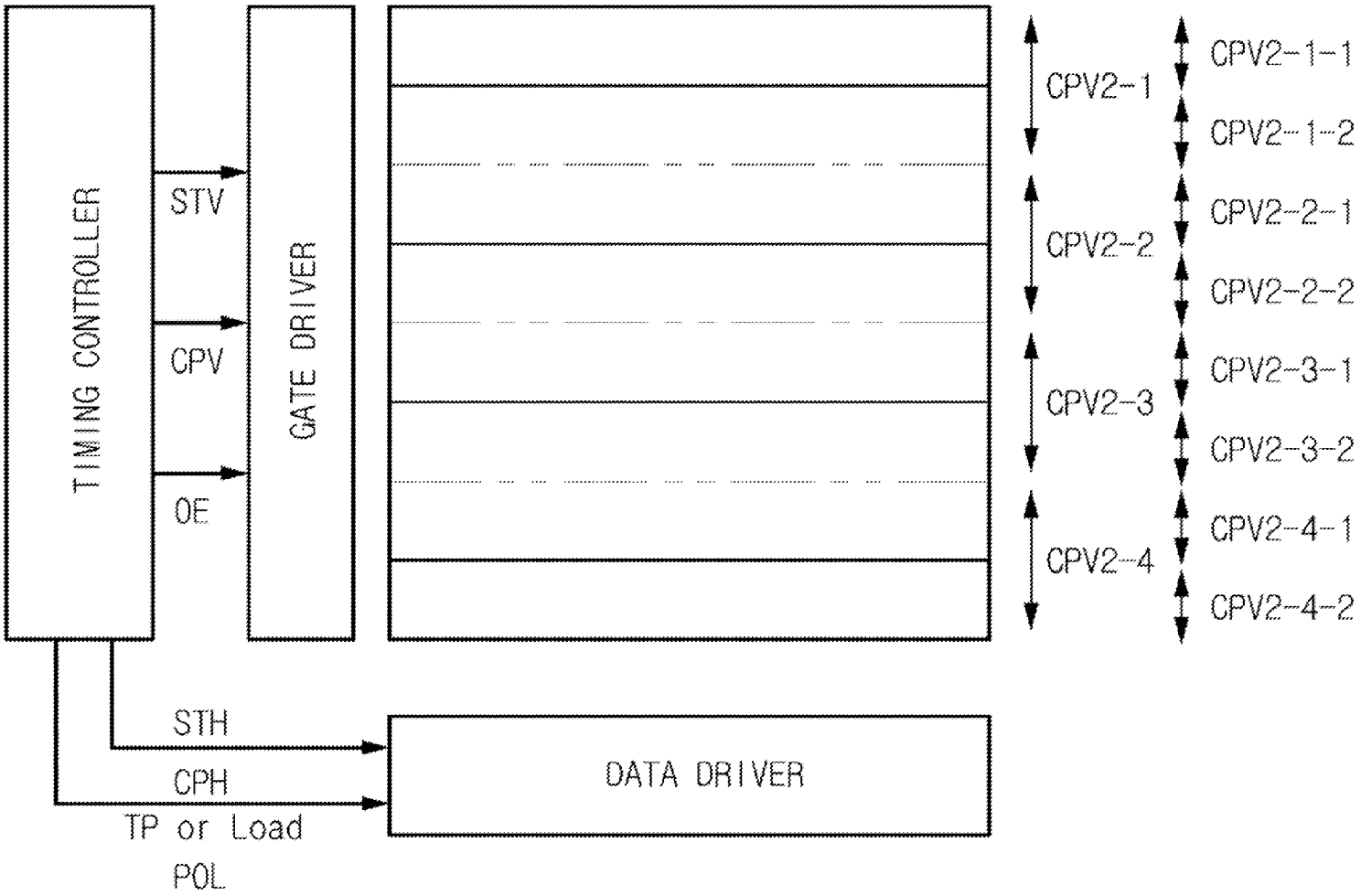
FIG. 4 is a configurative diagram of a liquid crystal driving apparatus according to an embodiment of the present disclosure.

An exemplary liquid crystal display driving apparatus for driving such a liquid crystal display according to an embodiment of the present disclosure is illustrated in FIG. 4.

A liquid crystal driving apparatus according to an embodiment of the present disclosure includes a gate driver configured to sequentially supply a scan pulse to a gate line, and a data driver.

Figure 5A:
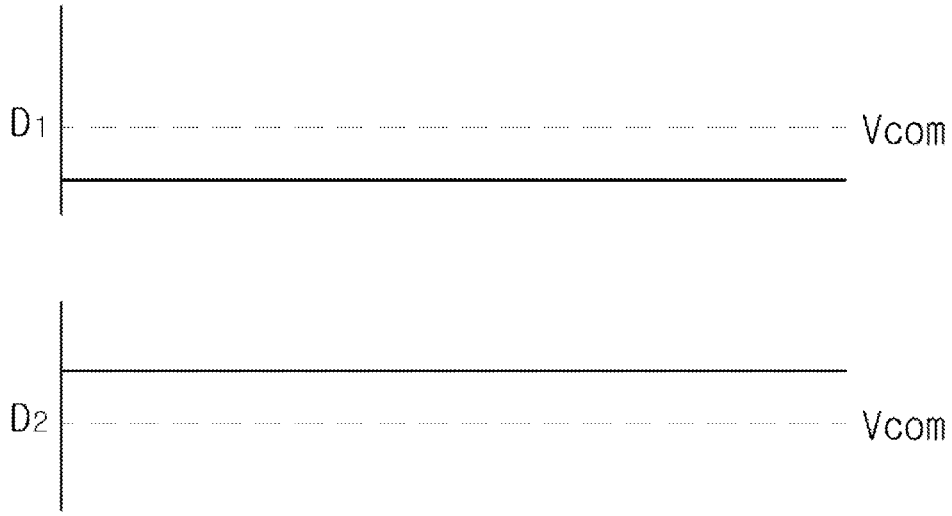
FIGS. 5A and 5B are diagrams illustrating a data signal for a liquid crystal display according to an embodiment of the present disclosure to be driven in the line inversion method.

In order for the data driver to drive the liquid crystal display according to an embodiment of the present disclosure illustrated in FIG. 3 in the line inversion method, in a frame as illustrated in FIG. 3, a data signal of a negative voltage(−) that is lower than a common voltage(Vcom) is supplied to odd number data lines (D1, D3, . . . ) and a data signal of a positive voltage(+) that is higher than the common voltage (Vcom) is supplied to even number data lines (D2, D4, . . . ) as illustrated in FIG. 5A.

Figure 5B:
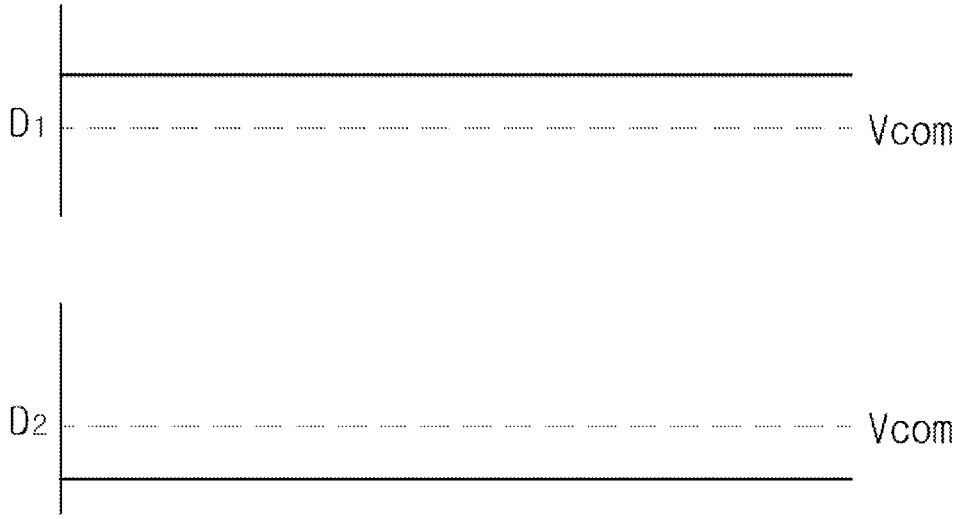

Furthermore, in a next frame, as illustrated in FIG. 5B, a data signal of a positive voltage (+) that is higher than the common voltage (Vcom) is supplied to odd number data lines (D1, D3, . . . ), and a data signal of a negative voltage(−) that is lower than the common voltage (Vcom) is supplied to even number data lines (D2, D4, . . . ).

In a conventional liquid crystal display illustrated in FIG. 1, in order to drive the liquid crystal display in the line inversion method, a polarity of a data voltage being supplied to a data line swings even in a same frame as illustrated in FIG. 2. On the other hand, in a liquid crystal display according to an embodiment of the present disclosure, in order to drive the liquid crystal display in the line inversion method, a data voltage of a same polarity is input in a same frame as illustrated in FIGS. 5A and 5B.

In such a liquid crystal display according to an embodiment of the present disclosure, since liquid crystal cells connected to one date line are provided with a data voltage of a same polarity, even when a pre-charging method is used to increase the charging speed, a charging difference will not occur between the liquid crystal cells connected to the data line, and thus it is possible to strike a balance of the charging characteristics.

Furthermore, since it is possible to increase a gate charge effective area and additionally pre-charge with a data voltage of a same polarity, there is an effect of increasing the actual charging efficiency.

Next, a gate driver of a liquid crystal driving apparatus and a gate signal being provided in the gate driver according to an embodiment of the present disclosure will be explained hereinafter.

The gate driver of a liquid crystal driving apparatus according to an embodiment of the present disclosure supplies a scan pulse to a gate line using a first clock signal (CPV1) and a second clock signal (CPV2). An exemplary circuit diagram of the gate driver is illustrated in FIG. 6.

Figure 6:
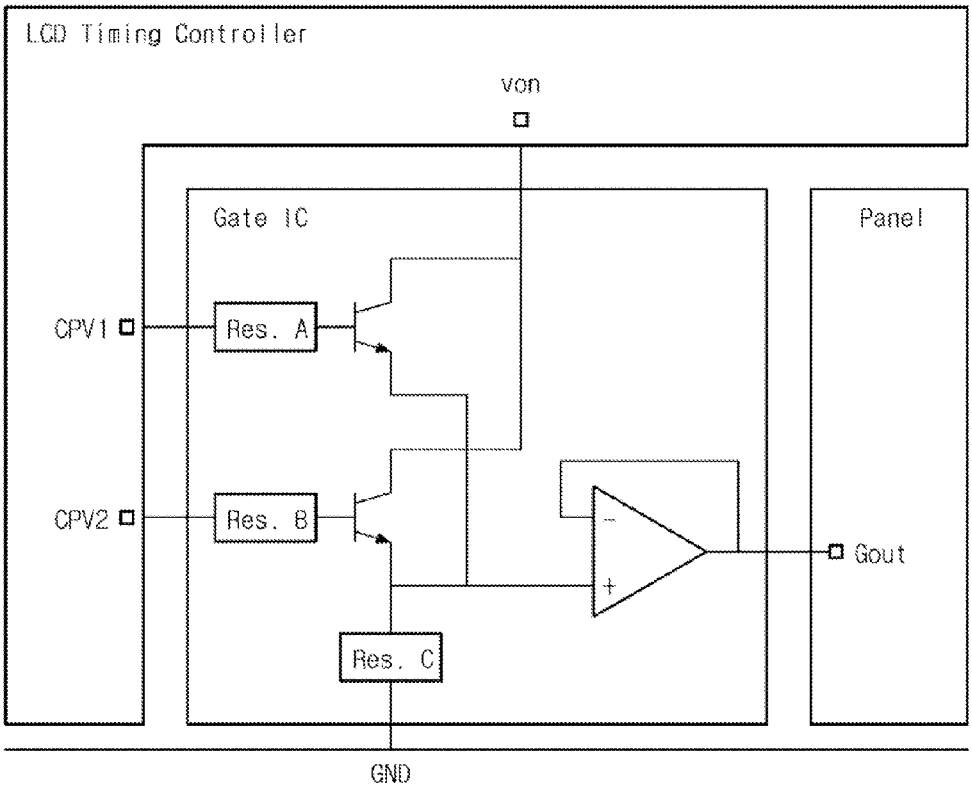
FIG. 6 is a circuit diagram illustrating an example of a gate driver of the present disclosure.

Herein, the first clock signal and the second clock signal are periodic gate clock signals provided from a timing controller as illustrated in FIG. 6.

In a liquid crystal display according to an embodiment of the present disclosure, one gate line is shared by liquid crystal cells of an odd number line and liquid crystal cells of an even number line as illustrated in FIG. 3.

Figure 7:
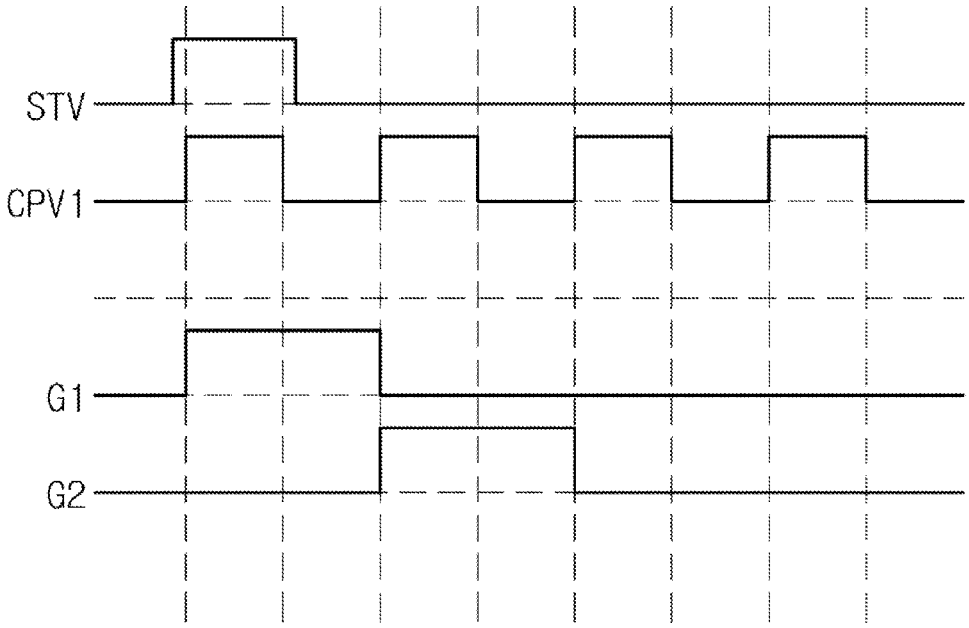
FIG. 7 is a diagram illustrating a basic scan pulse that is generated by a first clock signal.

Therefore, as illustrated in FIG. 7, when a first clock signal (CPV1) is output from a section synchronized to a scan start signal (STV), the gate driver is activated by the first clock signal and sequentially supplies a basic scan pulse to a gate line for 2H period of time. 1H period of time refers to a 1 line scanning time where data is inserted into pixels of 1 display line of the liquid crystal display.

In a liquid crystal display according to an embodiment of the present disclosure, liquid crystal cells of an odd number line and liquid crystal cells of an even number line share one gate line, and thus gate signals having a pulse width of 2H are sequentially output, and the gate signals are supplied to liquid crystal cells of the odd number row and even number row in a time-sharing method, and thus data signals are supplied to the liquid crystal cells of the odd number row for 1H period of time, and data signals are supplied to the liquid crystal cells of the even number row for the remaining 1H period of time. As such, the liquid crystal display according to the present disclosure applies the time-sharing method of gate driving signals, thereby having an effect of reducing the fan out.

Furthermore, in the present disclosure, an additional gate signal is output in order to secure a time for charging the liquid crystal cells that share one gate line, and for this purpose, the second clock signal (CPV2) is used. A more detailed explanation thereof is as follows.

Figure 8:
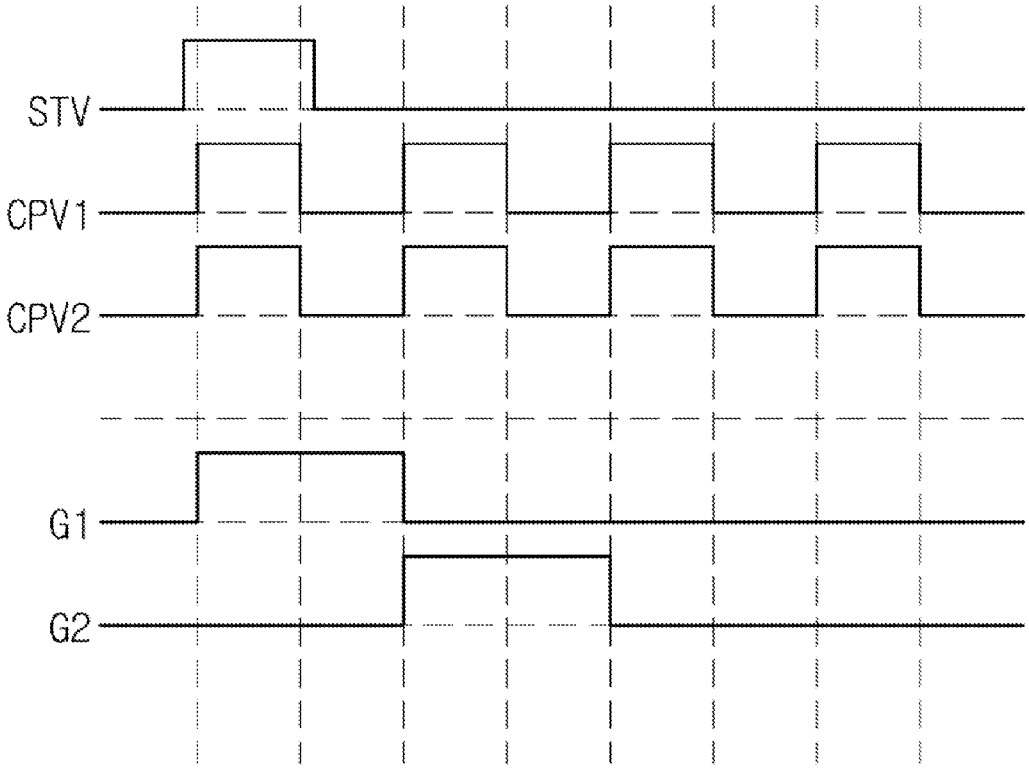
FIGS. 8 to 12 are exemplary diagrams illustrating a scan pulse that is generated by a timing difference of a first clock signal and a second clock signal.

As illustrated in FIG. 8, in a case where the second clock signal (CPV2) has a same timing as the first clock signal (CPV1), an additional gate signal is not output.

However, as illustrated in FIGS. 9 to 12, when it is adjusted such that the second clock signal has a time difference from the first clock signal, an additional scan pulse is provided before or after a basic gate output signal of 2H period of time.

Figure 9:
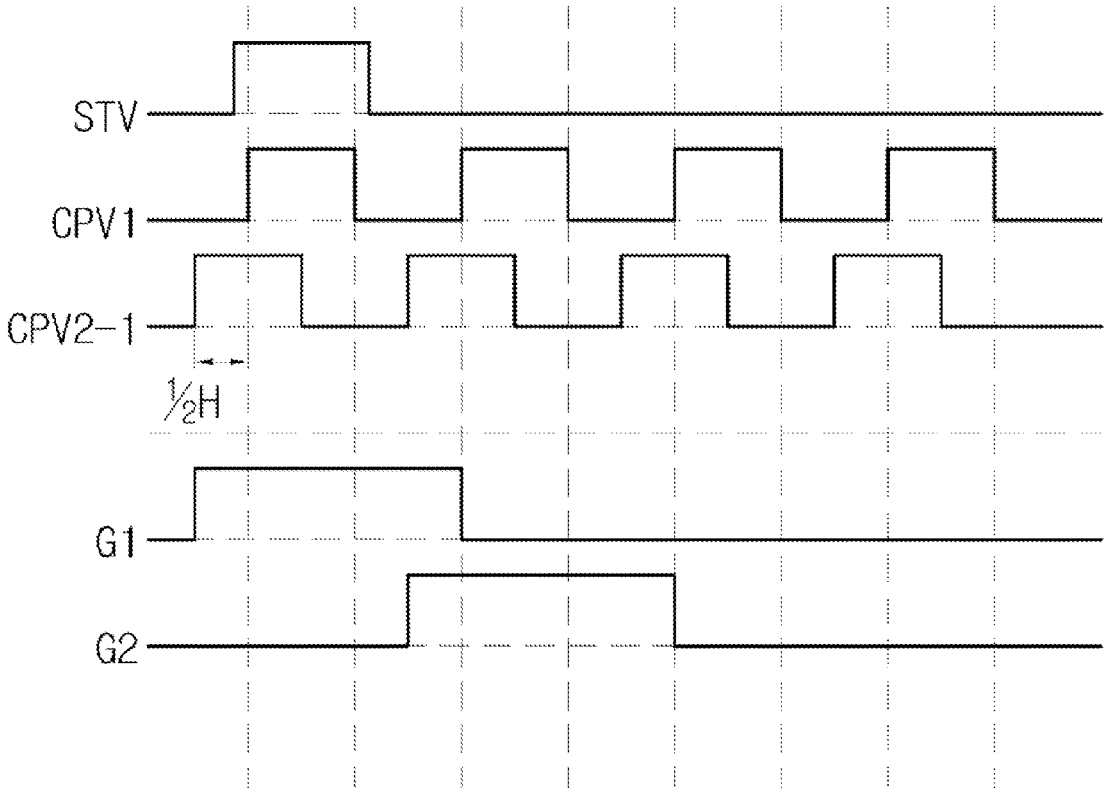

More specifically, as illustrated in FIG. 9, in a case where it is configured such that the second clock signal (CPV2-1) is input ½H prior to the first clock signal, a scan pulse of ½H is additionally generated at a front end of the basic scan pulse of 2H being provided to the gate line.

Therefore, a signal of ½H overlaps between the scan pulse being output to a neighboring gate line, and during this period, a data signal is pre-charged to the liquid crystal cells.

Figure 10:
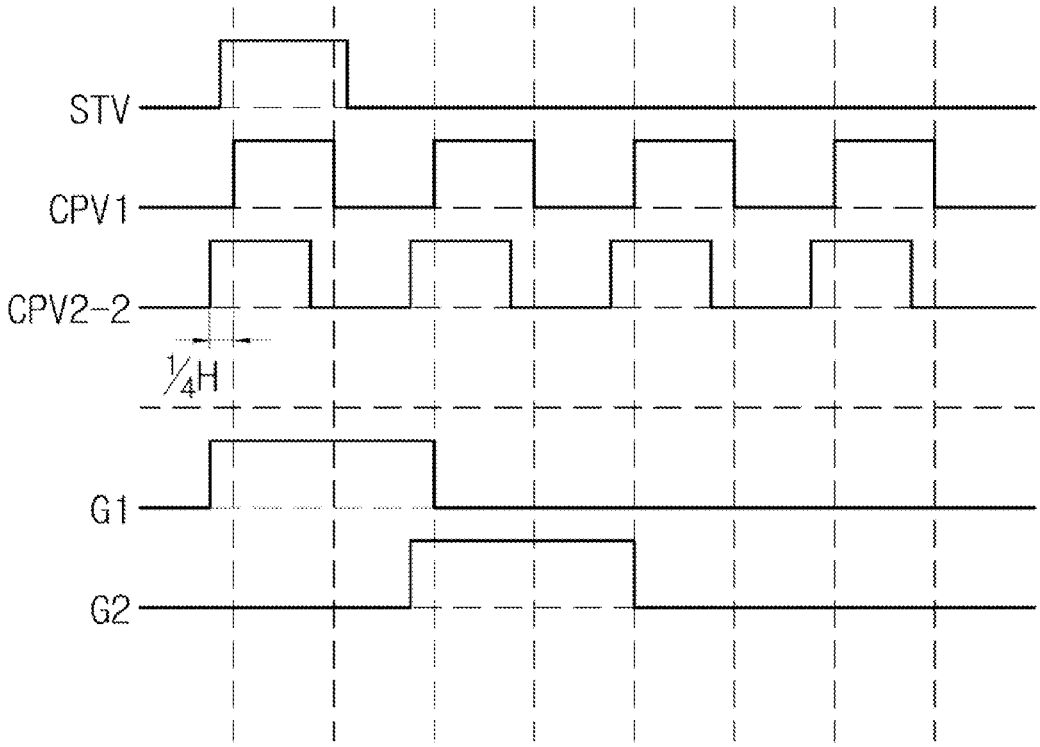

FIG. 10 is a case where a timing has been adjusted such that the second clock signal (CPV2-2) is input ¼H prior to the first clock signal, in which case a scan pulse of ¼H is additionally generated at a front end of the basic scan pulse of 2H being supplied to the gate line. A scan pulse signal overlaps for ¼H period of time, and during this period, a data signal is pre-charged to the liquid crystal cells.

Figure 11:
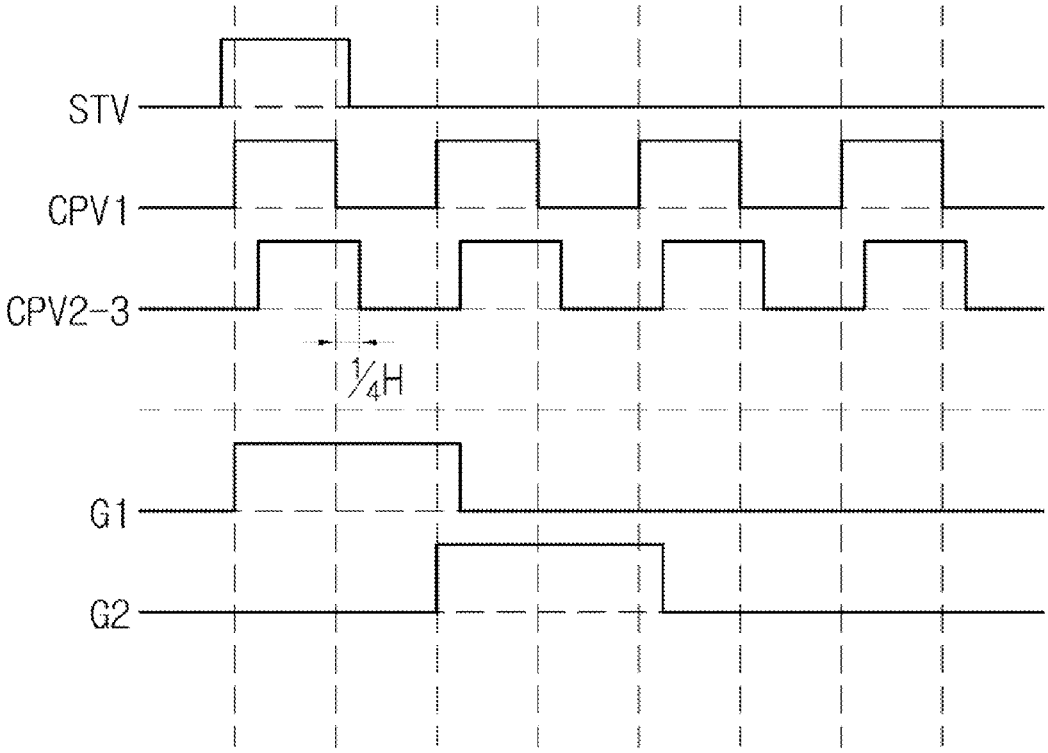
Figure 12:
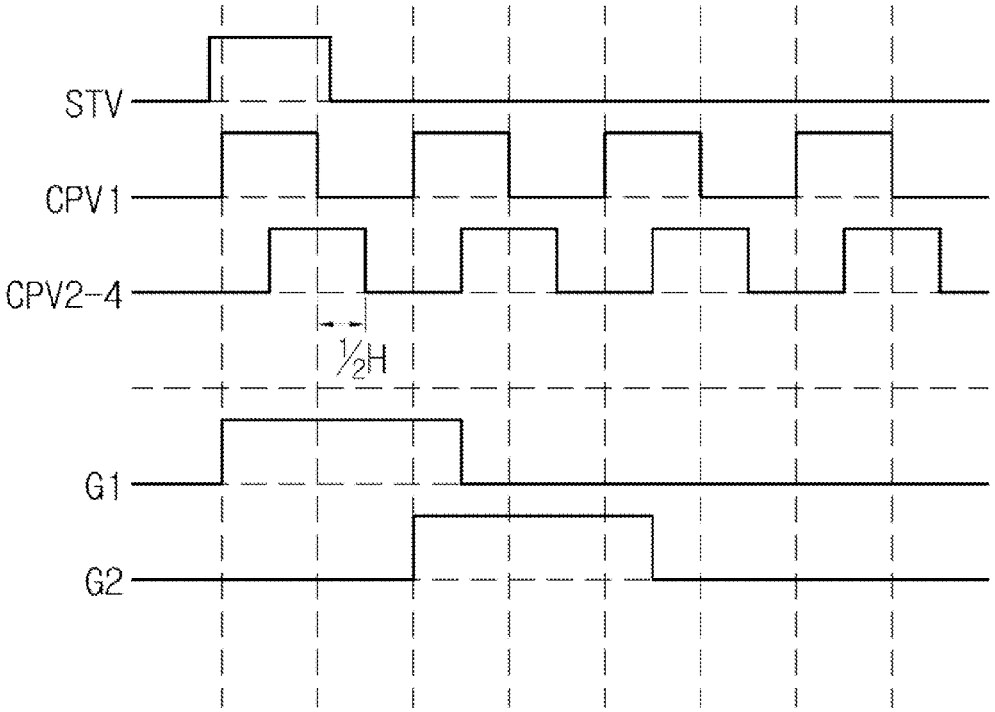

FIG. 11 illustrates a case where unlike in FIGS. 9 and 10, it is configured such that the second clock signal (CPV2-3) is input ¼H later than the first clock signal, and thus a scan pulse of ¼H is additionally generated at a rear end of the basic scan pulse of 2H, and FIG. 12 illustrates a case where it is configured such that the second clock signal (CPV2-4) is input ½ H later than the first clock signal, and thus a scan pulse of ½H is additionally generated at a rear end of the basic scan pulse of 2H.

In the cases of FIGS. 11 and 12, a scan pulse being output to their neighboring gate lines overlap by as much as ¼H and ½ H, respectively, and during this period of time, a data signal is pre-charged to the liquid crystal cells.

Such adjustment of timing of the second clock signal may be made in the timing controller as illustrated in FIG. 6, and be supplied to the gate driver, and FIGS. 9 to 12 illustrate a scan pulse overlapping for ½H or ¼H period of time, but the period of overlapping may occur up to 1 H, and one of various overlapping periods may be selected from a range of 0 to 1 H.

In a case where a pixel array is configured as illustrated in FIG. 3, and where an additional scan pulse is generated at a front end of the basic scan pulse as in FIG. 9 and FIG. 10, the charging time of the liquid crystal cells connected to an odd number gate line will increase, and in a case where an additional scan pulse is generated at a rear end of the basic scan pulse as in FIGS. 11 and 12, the charging time of the liquid crystal cells connected to an even number gate line will increase.

Therefore, a user may set a timing of a second clock signal differently for each area according to a load of the liquid crystal displayer, so as to strike a balance of charging characteristics between the liquid crystal cells even when each area of the liquid displayer has different loads. For this purpose, the timing controller may be provided with a look-up table for setting a timing of the second clock signal to be supplied to each gate line, and in this method, the timing controller may adjust the timing of the second clock signal for it to be provided to the gate driver and supply the same accordingly.

Furthermore, as liquid crystal displays become bigger, there occurs a time difference of a data signal being supplied between the liquid crystal cells disposed close to the data driver and the liquid crystal cells disposed far from the data driver.

Therefore, in order to charge the liquid crystal cells evenly in a large scale liquid crystal display, it is desirable to provide second clock signals (CPV2-3, CPV2-4) as those illustrated in FIGS. 11 and 12 to the liquid crystal cells close to the data driver as illustrated in FIG. 4, so that an additional scan pulse may be provided after the basic scan pulse, and it is desirable to provide second clock signals (CPV2-1, CPV2-2) as those illustrated in FIGS. 9 and 10 to the liquid crystal cells disposed far from the data driver, so that an additional scan pulse may be provided after the basic scan pulse.

Furthermore, it is desirable to further subdivide such that the closer the liquid crystal cells are to the data driver, the longer the period of the additional scan pulse being added after the basic scan pulse, and such that the farther the liquid crystal cells are from the data driver, the longer the period of the additional scan pulse being added before the basic scan pulse.

Furthermore, the timing that is adjusted as aforementioned is not limited to ½H and ¼ H, and thus, the timings of second clock signals (CPV2-1-1 and CPV2-1-2 of FIG. 4) may be further subdivided.

While this disclosure includes specific embodiments of a liquid crystal driving apparatus according to the present disclosure and a liquid crystal device comprising the same, it will be apparent to one of ordinary skill in the art that various changes or modifications in form and details may be made in these embodiments.

What is claimed is:

1. A liquid crystal driving apparatus comprising:

a gate driver configured to supply basic scan pulses to gate lines including two adjacent gate lines for 2H period of time using a first clock signal (CPV1), wherein 2H period of time is twice as great as 1H period of time wherein H corresponds to a line scanning time where data is inserted into pixels of one display line of a liquid crystal display; and a data driver configured to supply a data voltage to liquid crystal cells, wherein the gate driver provides an additional scan pulse before or after the 2H period of time of each of basic scan pulses using a second clock signal (CPV2) to provide scan pulses to the gate lines for a longer period than 2H period of time, the additional scan pulse being provided to one of the two adjacent gate lines overlapping a basic scan pulse being supplied to a remaining one of the two adjacent gate lines, and wherein the basic scan pulses supplied to the two adjacent gate lines are non-overlapping each other.

2. The apparatus of claim 1, further comprising a timing controller configured to adjust a timing of the second clock signal and provide the adjusted timing to the gate driver.

3. The apparatus of claim 2, wherein the timing controller adjusts a timing of the second clock signal with reference to a look-up table including information on a timing difference between the first clock signal and the second clock signal.

4. The apparatus of claim 3, wherein information of the look-up table provides that the additional scan pulse is provided for a longer period of time to a liquid crystal cell disposed in an area with a big load in a liquid crystal displayer.

5. The apparatus of claim 3, wherein information of the look-up table provides that the if a gate line is closer to the data driver, the additional scan pulse is provided after the 2H period of time, and if the gate line is farther from the data driver, the additional scan pulse is provided before the 2H period of time.

6. The apparatus of claim 5, wherein information of the look-up table provides that when the additional scan pulse is provided after the 2H period of time, the time during which the additional scan pulse is provided becomes greater for the gate line closer to the data driver, and when the additional scan pulse is provided before the 2H period of time, the time during which the additional scan pulse is provided becomes greater for the gate line farther away from the data driver.

7. The apparatus according to claim 1, wherein the additional scan pulse is provided between 0 and 1H.

8. The apparatus according to claim 1, wherein the data driver provides a data signal having different polarities from each other to first liquid crystal cells disposed in odd number lines and second liquid crystal cells disposed in even number lines.

9. The apparatus according to claim 1, wherein the gate driver is configured (1) when the first clock signal (CPV1) and the second clock signal (CPV2) completely overlaps each other, to supply the basic scan pulses to the gate lines for the 2H period of time, (2) when the second clock signal is ahead of the first clock signal by as much as t1 period of time, to provide the additional scan pulse for the t1 period of time before the corresponding basic scan pulse, and (3) when the second clock signal proceeds after the first clock signal by as much as t2 period of time, to provide the additional scan pulse for the t2 period of time after the corresponding basic scan pulse.

10. A liquid crystal display comprising:

a liquid crystal displayer disposed in an area including a plurality of gate lines, a plurality of data lines intersecting the gate lines, and a plurality of liquid crystal cells disposed in an area defined by the gate lines and data lines, wherein the liquid crystal cells include first liquid crystal cells disposed in odd number lines and connected to a data line disposed at a first side of the liquid crystal cells, second liquid crystal cells disposed in even number lines and connected to a data line disposed at a second side of the liquid crystal cells, the second side being opposite to the first side, and the first liquid crystal cells disposed in one of the odd number lines and the second liquid crystal cells disposed in a next even number line following the one of the odd number lines are connected to a same gate line; and a liquid crystal driving apparatus configured to provide a gate signal and a data signal to the data lines and the gate lines;

wherein the liquid crystal driving apparatus comprises:

a gate driver configured to supply basic scan pulses to the gate lines including two adjacent gate lines for 2H period of time using a first clock signal (CPV1), wherein 2H period of time is twice as great as 1H period of time wherein H corresponds to a line scanning time where data is inserted into pixels of one display line of the liquid crystal display; and a data driver configured to supply a data voltage to liquid crystal cells, wherein the gate driver provides an additional scan pulse before or after the 2H period of time of each of basic scan pulses using a second clock signal (CPV2) to provide scan pulses to the gate lines for a longer period than 2H period of time, the additional scan pulses being provided to one of the two adjacent gate lines overlapping a basic scan pulse being supplied to a remaining one of the two adjacent gate lines, and wherein the basic scan pulses supplied to the two adjacent gate lines are non-overlapping each other.

11. The apparatus of claim 10, further comprising a timing controller configured to adjust a timing of the second clock signal and provide the adjusted timing to the gate driver.

12. The apparatus of claim 11, wherein the timing controller adjusts a timing of the second clock signal with reference to a look-up table including information on a timing difference between the first clock signal and the second clock signal.

13. The apparatus of claim 12, wherein information of the look-up table provides that the additional scan pulse is provided for a longer period of time to a liquid crystal cell disposed in an area with a big load in a liquid crystal displayer.

14. The apparatus of claim 12, wherein information of the look-up table provides that if a gate line is closer to the data driver, the additional scan pulse is provided after the 2H period of time, and if the gate line is farther from the data driver, the additional scan pulse is provided before the 2H period of time.

15. The apparatus of claim 14, wherein information of the look-up table provides that when the additional scan pulse is provided after the 2H period of time, the time during which the additional scan pulse is provided becomes greater for the gate line closer to the data driver, and when the additional scan pulse is provided before the 2H period of time, the time during which the additional scan pulse is provided becomes greater for the gate line farther away from the data driver.

16. The apparatus of claim 10, wherein the additional scan pulse is provided between 0 and 1H.

17. The apparatus of claim 10, wherein the data driver provides a data signal having different polarities from each other to the first liquid crystal cells and the second liquid crystal cells.

18. The apparatus of claim 10, wherein the gate driver, is configured (1) when the first clock signal (CPV1) and the second clock signal (CPV2) completely overlaps each other, to supply the basic scan pulses to the gate lines for the 2H period of time, and (2) when the second clock signal is ahead of the first clock signal by as much as t1 period of time, to provide the additional scan pulse for the t1 period of time before the corresponding basic scan pulse, and (3) when the second clock signal proceeds after the first clock signal by as much as t2 period of time, to provide the additional scan pulse for the t2 period of time after the corresponding basic scan pulse.

19. A liquid crystal driving apparatus comprising: a gate driver configured to supply basic scan pulses to gate lines for 2H period of time using a first clock signal (CPV1), wherein 2H period of time is twice as great as 1H period of time wherein H corresponds to a line scanning time where data is inserted into pixels of one display line of a liquid crystal display; and a data driver configured to supply a data voltage to liquid crystal cells, wherein the gate driver provides an additional scan pulse before or after the 2H period of time using a second clock signal (CPV2) to provide scan pulses to the gate lines for a longer period than 2H period of time, the additional scan pulse being provided for a period of time overlapping the basic scan pulse being supplied to a neighboring gate line; wherein the liquid crystal driving apparatus further comprises a timing controller configured to adjust a timing of the second clock signal and provide the adjusted timing to the gate driver, and wherein the timing controller adjusts a timing of the second clock signal with reference to a look-up table including information on a timing difference between the first clock signal and the second clock signal.

20. The apparatus of claim 19, wherein information of the look-up table provides that the additional scan pulse is provided for a longer period of time to a liquid crystal cell disposed in an area with a big load in a liquid crystal displayer.

* * * * *